US005156340A

United States Patent [19]

Lopes

[11] Patent Number: 5,156,340

[45] Date of Patent: Oct. 20, 1992

[54] FLUID SPRAY GUN

[76] Inventor: Gregory A. Lopes, 836 W. Lincoln, #E-10, Woodland, Calif. 95695

[21] Appl. No.: 644,931

[22] Filed: Jan. 23, 1991

[51] Int. Cl.[5] ..... B05B 7/12

[52] U.S. Cl. ..... 239/414; 239/412; 239/413; 239/398

[58] Field of Search ..... 239/61, 398, 407, 412, 239/413, 414, 415, 416.5, 417.5, 420, 332

[56] References Cited

U.S. PATENT DOCUMENTS

| | | | |
|---|---|---|---|
| 1,958,730 | 5/1934 | Tracy | 239/415 |
| 2,436,335 | 2/1948 | Simonsen | 239/420 |
| 2,804,343 | 8/1957 | Friedell | 239/398 |
| 3,302,891 | 1/1967 | Faro et al. | 239/407 |
| 4,288,036 | 9/1981 | Jubinville | 239/414 |
| 4,609,149 | 9/1986 | Jessen | 239/416.5 |
| 4,822,644 | 4/1980 | Krueger | 427/280 |
| 4,850,536 | 7/1989 | Teranishi et al. | 239/332 |
| 4,878,619 | 11/1989 | Norman | 239/318 |
| 4,878,621 | 11/1989 | Krueger | 239/458 |

*Primary Examiner*—Andres Kashnikow
*Assistant Examiner*—Lesley D. Morris
*Attorney, Agent, or Firm*—Flehr, Hohbach, Test, Albritton & Herbert

[57] ABSTRACT

A spray system is disclosed which includes a spray gun for the hand-operated spraying of fluid material with pressurized air. A spray gun body includes a barrel chamber having an air tube which directs air outwardly through a discharge port with entrained material in a spray. A bistable control valve operates responsive to movement of a trigger for controlling the flow of both air pressure and material into the barrel chamber. The control valve is bistable in its operation to either close the air flow off when the trigger is in its off position or to open the air flow when the trigger is in any of its operating positions. Air tube adjustment means is provided for manually controlling the spray pattern during operation. An electrical control circuit is provided to control a material flow pump responsive to movement of the trigger.

13 Claims, 3 Drawing Sheets

FLUID SPRAY GUN

BACKGROUND OF THE INVENTION

This invention relates in general to fluid spray systems, and more particularly relates to a spray gun for use with a variety of viscous and semi-viscous materials such as paint, plaster, acoustic dry wall material, waterproofing, fireproofing and mortar for stucco application.

Various types of spray guns have been provided for applying fluid materials to walls, ceilings and other building structures and surfaces. Many of these prior spray guns are difficult and inconvenient to operate. Thus, to turn such a gun off the operator must shut the material pump off at the same time the material flow valve is closed. If the pump does not shut down when the valve is closed the hoses can rupture and blow. The operator must also try to simultaneously turn the pump on when the air valve is opened. Other problems are that typical existing spray guns normally require the use of both hands for operation, and this results in making it more difficult to spray in confined spaces such as closets, underneath stairwells and the like. Existing spray guns also are vulnerable to breakage or going out of adjustment, such as when the gun is accidentally dropped. Moreover, after a gun is shut down it is difficult to re-establish the same spray pattern when turned back on in that the spray pattern is dependent on the number of turns of the flow valve to shut it off. The operator must remember to open the valve up to the same number of turns, otherwise the same spray pattern will not be achieved for resuming the spraying operation.

OBJECTS AND SUMMARY OF THE INVENTION

It is accordingly a general object of the present invention to provide a new and improved fluid spray gun which obviates many of the disadvantages and limitations of existing spray guns.

Another object is to provide a spray gun of the type described which is relatively more easy to handle and operate and, as desired, can easily be operated by one hand of the worker.

Another object is to provide a spray gun of the type described which coordinates material flow control simultaneous with on/off spray operation.

Another object is to provide a spray gun of the type described which operates to supply immediate air pressure to the gun's barrel chamber when the material flow valve is opened.

Another object is to provide a spray gun of the type described which can be repeatedly turned on and off while maintaining a predetermined setting for the spray pattern.

Another object is to provide a spray gun of the type described in which a single hand-operated trigger controls on/off operation as well as material flow rate into the spray.

The invention in summary provides a spray gun with a gun body having a barrel chamber with a discharge port. A single hand-operated trigger provides simultaneous control of the pressurized air and material flow to the barrel chamber. An air control valve bistably operates between a closed position when the trigger is off and an open position when the trigger is moved through a stepless range of operating positions. Immediately when the control valve moves from its closed position air pressure is directed to the barrel chamber. Material control valve means is provided for controlling the flow rate of material into the chamber proportional to movement of the trigger to an operating position. A spray valve entrains material with the pressurized air into a stream which discharges outwardly through the port in a spray pattern.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
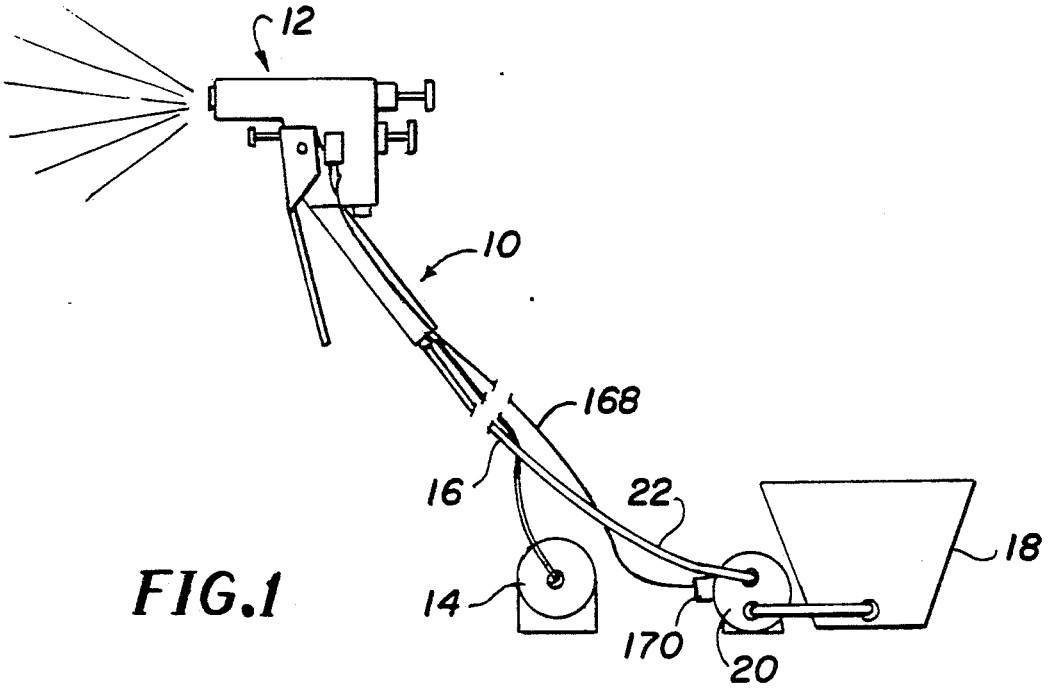
FIG. 1 is an elevational view illustrating a fluid spray gun and associated pump equipment in accordance with one embodiment of the invention.
Figure 2:
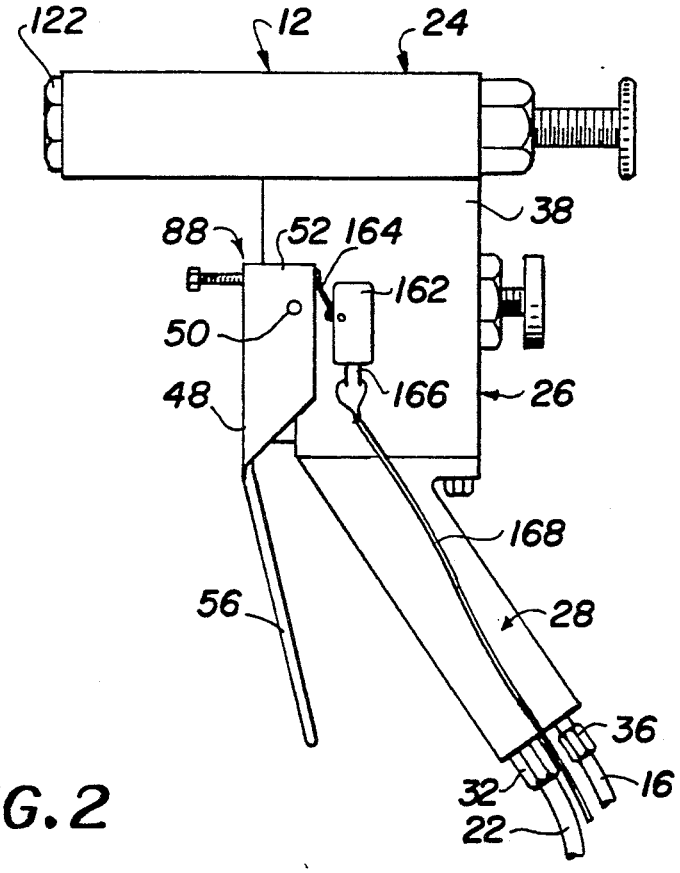
FIG. 2 is a side elevational view to an enlarged scale of the spray gun of FIG. 1.

In the drawings FIG. 1 illustrates generally at 10 a spray system incorporating a preferred embodiment of the invention. Spray system 10 includes a spray gun 12, a pressurized air supply comprising a compressor pump 14 which feeds air through flexible air hose 16 to the gun, and a supply hopper 18 and worm drive pump 20 which pumps the fluid material under pressure through flexible hose 22 to the gun.

Fluid spray system 10 of the invention is adapted for spraying a wide variety of viscous and semi-viscous fluid materials including paint, plaster, acoustic dry wall, wall/ceiling texturing, waterproofing, fireproofing and mortar for stucco application.

Spray gun 12 is comprised of a gun body which includes a barrel assembly 24, a valve assembly 26 mounted below the barrel assembly and a grip handle 28 mounted below the valve assembly. The grip handle inclines at approximately a 30° angle downwardly and behind the valve assembly to permit the operator to comfortably hold the gun so that it can be easily pointed to direct the spray. Barrel assembly 24 is releasably secured to the valve assembly by suitable fasteners so that one or more additional barrel assemblies, not shown, of different size can be interchanged for spraying materials of different weights and viscosities. For example, a large size barrel would be used for heavy, viscous material such as plaster and waterproofing while a smaller barrel would be used for paint.

Grip handle 28 is formed with an internal axial bore 30 which provides a first channel for directing the flow of material into the valve assembly. A coupling 32 is provided at the lower end of the handle for connecting the first channel with material supply hose 22. The handle is formed with another axial bore 34 which provides a second channel for directing pressurized air upwardly into the valve assembly. A connector fitting 36 is mounted at the lower end of the handle for connecting the second channel with air hose 16.

Valve assembly 26 is comprised of a housing 38 formed with an upwardly extending bore 39 which is aligned with and forms an extension of the upper end of first channel bore 30 in the handle. The valve housing is also formed with a series of bores 40, 42, 44 which provide an extension of the upper end of second channel bore 34 in the handle for the air supply. The path of air flow in this extension of the second channel through the valve assembly is along the circuitous path indicated by the arrow 46.

A hand-operated trigger 48 is mounted on the front end of the valve housing for pivotal back-and-forth movement about the axis of a mounting pin 50. The upper portion of the handle is generally U-shaped with its side walls 52, 54 pivotally moving along the front outer walls of the valve housing. The trigger's lower extension 56 is flat and inclines rearwardly for comfortable grasp by the operator's fingers.

Figure 3:
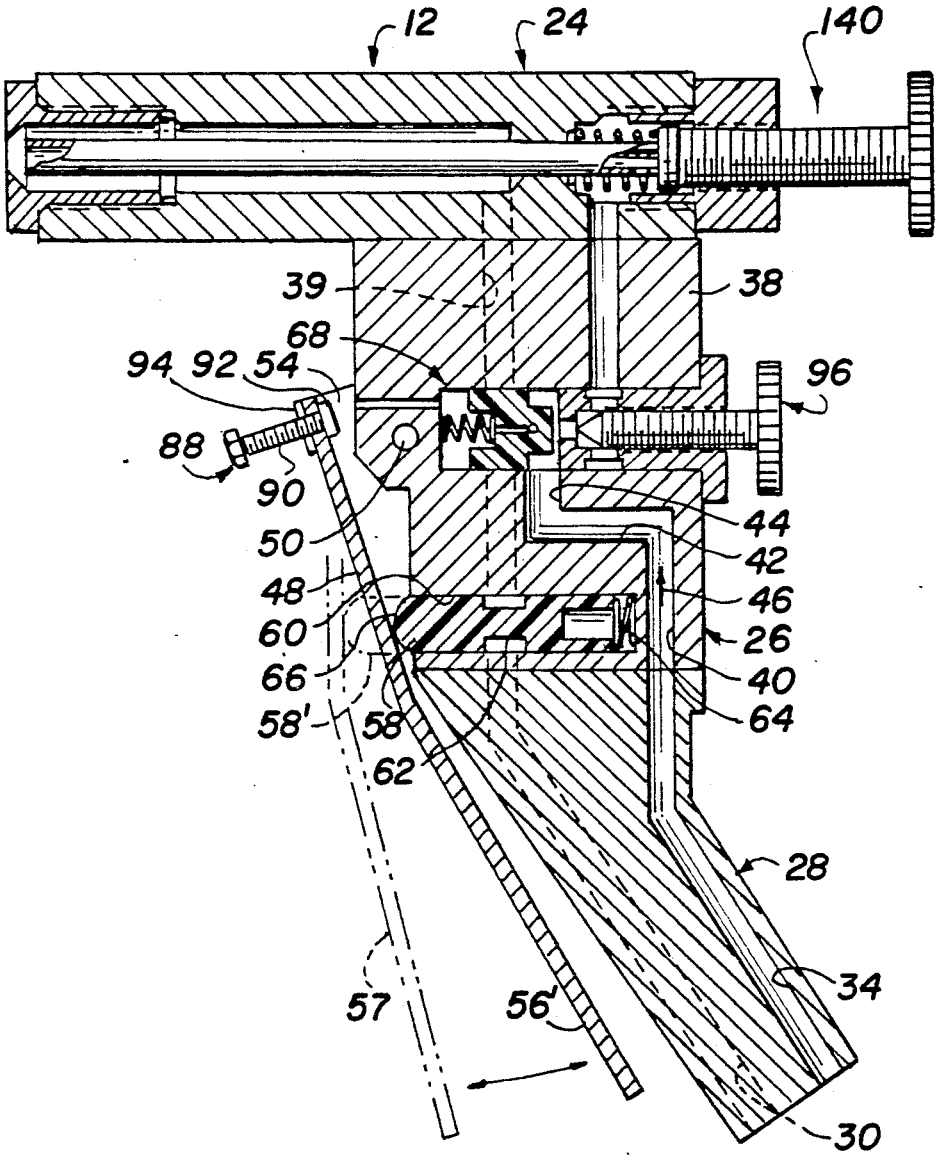
FIG. 3 is a vertical section view of the spray gun of FIG. 2.

Means for controlling the flow rate of material through first channel extension 39 is provided and comprises a spindle valve 58. The spindle valve is mounted for reciprocating movement in a cross bore 60 which transects at right angles with first channel extension 39. The spindle valve is formed with a reduced-diameter mid-portion 62 around which the material flows when any part of the mid-portion is moved into alignment with the first channel. A compression spring 64 is mounted within the base of cross bore 60 to urge the spindle valve to the left as viewed in FIG. 3. A rounded outer tip 66 on the spindle valve contacts the inside surface of the trigger. The rounded tip acts as a camming surface against which the trigger bears for moving the spindle valve inwardly. The trigger is manually pivoted from its off position, indicated in broken line at 57 in FIG. 3, inwardly through a stepless series of operating positions. In the off position the spindle valve is at position 58' where it occludes the flow through first channel bores 30 and 39. Progressive movement of the spindle valve to the right through the series of operating positions proportionally increases the flow rate of material upwardly through the first channel.

Figure 4:
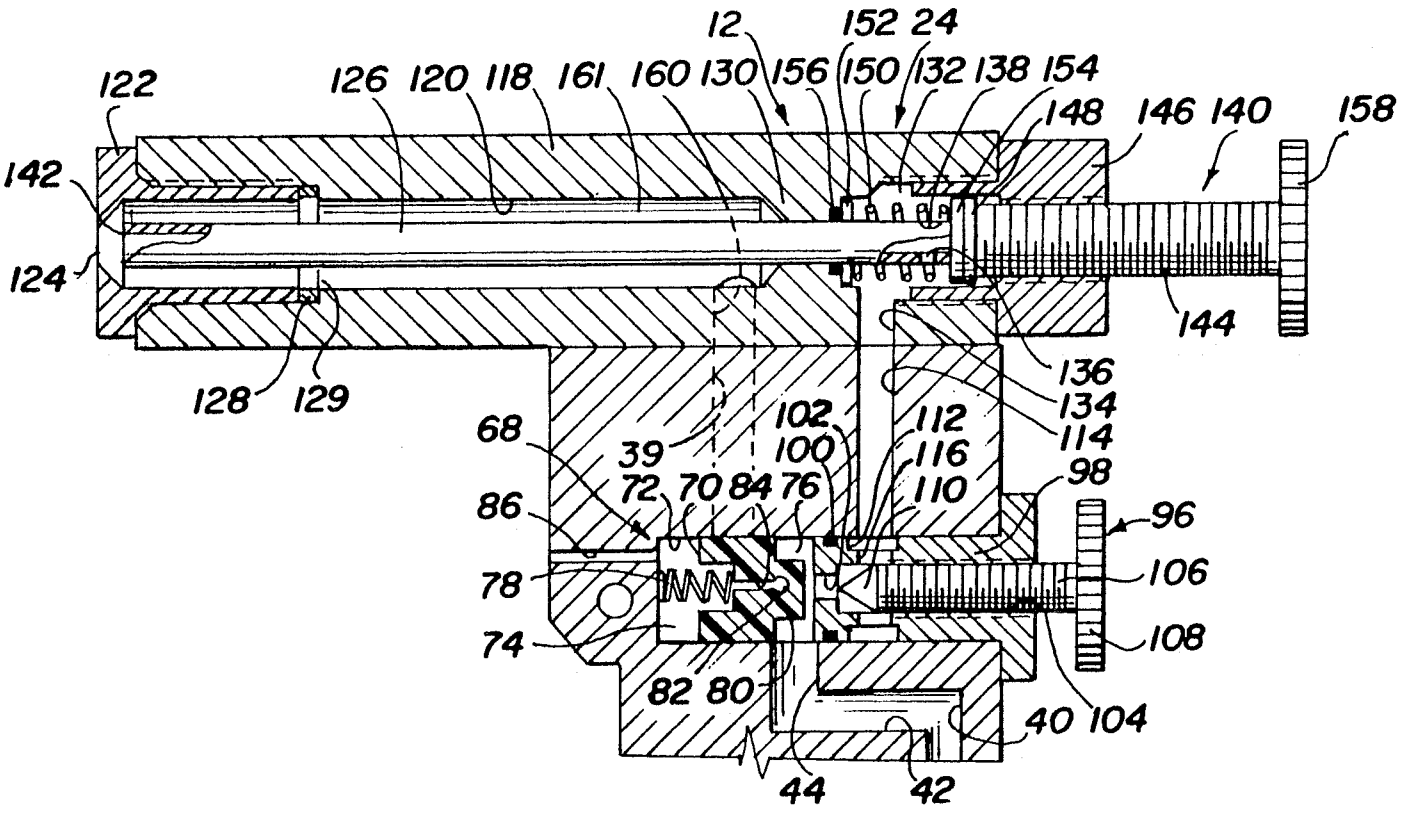
FIG. 4 is a fragmentary, vertical section view to an enlarged scale of the air control valve and barrel assembly of the spray gun of FIG. 2.

Bistable control valve means 68 is provided for supplying air pressure to the barrel assembly instantaneous upon operation of the trigger for pumping material. As best shown in FIG. 4, valve means 68 comprises a displacement piston 70 which is mounted for reciprocating movement within a second cross bore 72 formed in valve housing 38. The second cross bore transects at right angles with upwardly extending second channel bore 44 for the air flow. The second cross bore 72 is laterally spaced in front, as viewed in FIG. 4, of first channel bore 39 so that the path of material flow does not commingle with the path of air flow through the valve housing. Cross bore 72 forms an air chamber having a base end 74 toward the front side of the housing and a head end 76 on the inside in communication with bore 44 of the second channel. A compression spring 78 is mounted within the base end and acts against the piston to urge it to the right, as viewed in FIG. 4. A reduced-diameter head 80 is formed on the inner end of the piston.

Pressurized air from head end 76 of the air chamber is fed into the base end through a path formed by a first small diameter hole 82 which extends diametrically through piston head 80 and second small diameter hole 84 which extends axially through the piston in communication with the first hole.

Actuating means is provided for creating a lower air pressure in the base end to actuate the piston to the left. The actuating means comprises at least one small diameter bleed hole 86 which extends from the air chamber base end forwardly through the valve housing, emerging at a bleed opening on the front face of the housing. A control head 88 is mounted on the upper end of the trigger for controlling the bleed of air through bleed hole 86. The control head is comprised of a bolt 90 having machine threads which are mounted through an opening in the trigger. Inner end 92 of the bolt is formed with a flat surface which seats against and closes off the bleed opening when trigger 56 is in its off position. A lock nut 94 is threaded on the opposite side of the bolt for selectively varying the distance at which the flat end 92 is positioned from the trigger. Adjustment of the bolt in this manner provides a means for selectively varying the position of the trigger which closes the bleed hole. When the bleed hole is closed air pressure within the air chamber is equalized on both sides of displacement piston 70, thereby permitting the action of spring 78 to urge the piston to the right to its closed position. When the trigger is pivoted counterclockwise, as viewed in FIG. 3, from its off position to any of the operating positions control head 88 is moved away from the bleed hole permitting air to escape from the base end of the chamber. This creates a lower air pressure at the base end relative to the head end, and when the pressure differential is sufficient to overcome the force of spring 78 the pressure immediately moves the piston to the left.

Pressure control valve assembly 96 is provided for controlling air pressure downstream of bistable control valve 68. Valve assembly 96 comprises a valve body 98 which is threadably mounted within a coaxial extension of the bore 72 which forms the air chamber. The distal end of the valve body is formed about its periphery with a groove which seats an O-ring 100 to provide an air pressure seal at the head end of the air chamber. An internal bore providing a valve seat 102 is formed through the valve body distal end with a diameter less than that of piston head 80. Extending through the proximal end of the valve body is a second bore 104 which threadably mounts the shank of an adjusting screw 106. A knob 108 on the outer end of the adjusting screw is provided for manually turning the screw in and out. The distal end of the adjusting screw is formed with a conical tip 110 which moves toward and away from valve seat as the screw is adjusted in and out. A peripheral groove 112 formed at a mid-portion of the valve body is in alignment with a bore 114 which extends upwardly through housing 38 as a continuation of the second channel. One or more radial holes 116 are formed in the valve body inwardly of groove 112 for directing the flow of air moving past the valve tip into the groove and thence into bore 114. As adjusting screw 106 is turned in and out the change in clearance between the valve tip and valve seat controls the downstream pressure in the path of air flow.

Barrel assembly 24 includes a body 118 formed internally with an elongate barrel chamber 120. A screw-in spray tip 122 is threadably mounted within the front end of the barrel body. A discharge port 124 is formed coaxially through the spray tip and communicates with the barrel chamber. The tip is formed with a hex head configuration to facilitate manual installation. The tip can be interchanged with one or more additional tips having discharge ports of varying diameters for use in spraying different materials. These different tips can have discharge ports with diameters ranging from pinhole size up to ¼", as required by the particular material being sprayed.

An elongate, hollow air tube 126 is mounted coaxially within barrel chamber 120. The forward end of the air tube is supported in radially spaced relationship from the chamber by means of an alignment ring 128 which is seated at the base of the opening in which the spray tip is mounted. The alignment ring has a plurality of inward radial projections 129 which support the tube while permitting axial flow of the material. The rearward end of the air tube is supported by a circular land 130 formed at the end of the barrel chamber. On the back side of the land an enlarged air chamber 132 is formed within the barrel body. An inlet hole 134 is formed down from air chamber 132 through the body and is in alignment with bore 114 leading up from pressure control valve assembly 96. The inlet end of the air tube is formed with a pair of ports 136, 138 for directing air from the chamber into the tube.

Spray control means 140 is provided for axial displacement of the air tube within the barrel chamber for moving the tube's outlet end 142 to a selected position spaced from discharge port 124. Control means 140 includes an adjustment screw 144 which is threadably mounted within a set nut 146 which is in turn threadably mounted in the rear end of barrel body 118. A circular plug 148 is secured to the inlet end of the air tube, and the plug seats against the inner end of the adjustment bolt. Contact between air tube plug 148 and the adjustment bolt is maintained by a compression spring 150 which is mounted about the air tube between a pair of washers 152, 154 which in turn are mounted about the tube. An O-ring 156 is mounted in a groove formed in land 130 to provide an air-tight seal which prevents air pressure from leaking into the barrel chamber. A knob 158 is provided on the distal end of adjustment bolt 144 to facilitate manually turning the bolt in and out and thereby move the discharge end of the air tube toward and away from discharge port for controlling the spray dispersion pattern.

A hole 160 is formed from barrel chamber 120 down through body 118 into alignment with the upwardly extending bore 39 in housing 38 to feed the flow of material from the first channel into the annulus 161 which is defined between the air tube and barrel chamber. Pressurized air discharging from air tube end 142 entrains material from the annulus for discharge in a spray from port 124.

Operation of material feed pump 20 responsive to trigger movement is controlled by limit switch 162 which is mounted on a side wall of valve housing 38. The outer end of a contact arm 164 on the limit switch is spring-biased against the upper edge of the trigger. A pair of terminals 166 extending through the bottom of the switch are connected to a pair of wires which lead through an insulated cable 168 to a pump control 170 on the material pump. The contact arm is adjusted so that as soon as the trigger is pivoted counterclockwise from its off position electrical contacts within the switch are operated to close the circuit and operate the material pump. The circuit is closed throughout movement of the trigger to any of its operating positions, and is again opened to shut the pump down when the trigger returns to its off position.

In operation of the fluid spray system, hopper 18 is filled with a supply of the fluid material and air compressor pump 14 is turned on. Holding the spray gun in one hand, the operator initiates spraying by pulling back the lower extension of trigger 48. This actuates switch 162 to close the circuit to the control of pump 20 which begins pumping material up into hose 22. Simultaneously the movement of the trigger from its off position moves spindle valve 58 so that material begins to flow, at a rate proportional to trigger displacement, up through the first channel and into barrel chamber 120 and the annulus about the air tube.

As soon as the trigger is moved from its off position bistable control valve 68 operates to deliver air pressure through control valve assembly 96 and into the air tube. Valve 68 is bistable in that it remains in its stable closed position as long as the trigger is in its off position, and remains in its stable open position as long as the trigger is at any of the operating positions. In its off position the trigger positions adjustable control head 88 to occlude bleed hole 86, thereby equalizing pressure within air chamber 74 on both sides of displacement piston 70 and permitting spring 78 to move the piston so that the air flow through valve seat 102 is closed off. Movement of control head 88 away from the bleed hole causes the pressure in base end 72 of air chamber 74 to bleed off so that the pressure in the head end moves the piston away from the valve seat. This permits air to immediately flow past adjustment screw tip 110 and up through bores 114 and 134 to chamber 132 of the barrel assembly. The pressurized air then enters the air tube through openings 136 and 138 and exits the tube in a stream which discharges through port 124. As the air stream discharges it entrains material from the barrel chamber, breaking the material up into small particles which are forcefully dispersed in a spray pattern. The spray dispersion pattern can be selectively adjusted during operation by manually turning air tube adjustment screw 144. The screw advances in or out of set nut 146 and thereby axially displaces the air tube to vary the clearance between its end 142 and discharge port 124.

The air pressure delivered to the air tube can also be selectively adjusted during operation by manually turning adjusting screw 106. The spraying operation can be rapidly shut down by the single step of releasing the trigger. The spring force acting on spindle valve 58 pivots the trigger back to its off position so that control head 92 closes off bleed hole 86. Bistable control valve 68 responds by immediately shutting off air flow into air tube 126, while the return movement of spindle valve 58 also shuts off material flow. Return of the trigger to its off position also actuates switch 162 to open the circuit for turning material pump 20 off. When the spray gun is subsequently operated the previously-established spray volume and pattern is re-established.

While the foregoing embodiments are presently considered to be preferred it is understood that numerous variations and modifications may be made therein by those skilled in the art and it is intended to cover in the appended claims all such variations and modifications as fall within the true spirit and scope of the invention.

What is claimed is:

1. A spray gun for spraying fluid material with pressurized air, said gun comprising the combination of: a gun body, a barrel chamber in the body, said chamber including a discharge port which opens outwardly from the body, means for supplying said material under pressure through a first channel into said chamber, means for supplying said air under pressure through a second channel into said chamber, a trigger mounted on the gun body for movement between an off position and any operating position, material control valve means for controlling the flow rate of material through said first channel responsive to movement of the trigger to an operating position, air control valve means for bistably operating between a closed position responsive to the off position of the trigger and an open position responsive to an operating position of the trigger, said control valve means in its closed position closing air flow through said second channel and in its open position fully opening air flow through said second channel and into said chamber, and spray valve means for entraining material with air into a stream and for directing the stream outwardly through the discharge port in a spray responsive to said air flow through the second channel into the chamber.

2. A spray gun as in claim 1 in which said air control valve means includes an air chamber in the gun body, a displacement piston mounted for movement within the air chamber between open and closed positions, said piston in its closed position blocking the path of air flow through the second channel and in its open position enabling air flow through the second channel, and control means for causing bistable movement of the piston between its open position responsive to an operating position of the trigger and its closed position responsive to the off position of the trigger.

3. A spray gun for spraying fluid material with pressurized air, said gun comprising the combination of: a gun body, a barrel chamber in the body, said chamber including a discharge port which opens outwardly from the body, means for supplying said material under pressure through a first channel into said chamber, means for supplying said air under pressure through a second channel into said chamber, a trigger mounted on the gun body for movement between an off position and an operating position, material control valve means for controlling the flow rate of material through said first channel responsive to movement of the trigger to an operating position, air control valve means for bistably operating between a closed position responsive to the off position of the trigger and an open position responsive to any operating position of the trigger, said control valve means in its closed position closing air flow through said second channel and in its open position fully opening air flow through said second channel and into said chamber, spray valve means for entraining material with air into a stream and for directing the stream outwardly through the discharge port in a spray responsive to said air flow through the second channel into the chamber, said air chamber includes a base end and a head end each of which is in communication with pressurized air from said second channel, said displacement piston having its open position located at the base end and its closed position located at the head end, and said control means includes means for creating a lower air pressure in said base end relative to air pressure in said head end responsive to said trigger being in an operating position whereby the air pressure in the head end acts against and moves the piston toward its open position.

4. A spray gun as in claim 3 in which said means for creating lower air pressure in the base end comprises at least one bleed hole in the base end for bleeding air out of the base end, said control means further including means for occluding the bleed hole to prevent the bleed of air from the base end responsive to the trigger being in its off position.

5. A spray gun as in claim 3 in which said means for creating the lower air pressure includes means for releasing air from the base end along a bleed path responsive to said trigger being in an operating position, and said control further includes bleed control means for selectively varying the position of the trigger which causes said release of air along the bleed path.

6. A spray gun as in claim 5 in which said bleed control means includes a control head carried by the trigger to a position blocking said bleed path for preventing release of air therefrom when the trigger is in an operating position, and means for moving the control head to a selected location on the trigger at which said release of air along the bleed path takes place.

7. A spray gun as in claim 3 which includes spring means for yieldably urging the piston toward its closed position when said base and head ends have substantially equal air pressure with the trigger in its off position.

8. A spray gun as in claim 1 in which said means for supplying material comprises a source of fluid material and pump means for pumping material from the source under pressure to the first channel, and pump control means for operating the pump means responsive to movement of said trigger from the off position to an operating position and for shutting said pump means off when said trigger is in its off position.

9. A spray gun as in claim 1 in which the trigger is mounted for movement through a graduated series of operating positions, and said material control valve means controls the flow rate of material through the first channel substantially proportional to said movement of the trigger through the operating positions.

10. A method for spraying fluid material with pressurized air from a discharge port in a barrel chamber of a spray gun having an operating trigger, the method including the steps of directing material under pressure along a first channel into the barrel chamber, controlling the flow rate of material through the first channel when the trigger is moved to any operating position from an off position, directing air under pressure through a second channel into the barrel chamber, entraining material in a stream of the pressurized air which discharges in a spray through the discharge port, controlling a displacement piston for bistable movement between closed and open positions responsive to the trigger being in respective off and operating positions, closing air flow through the second channel when the piston is in its closed position to shut off discharge of air and material through the discharge port, and substantially immediately opening air flow through the second channel when the piston is moved from its closed position whereby air pressure is directed to the barrel chamber.

11. A method as in claim 10 including the step of selectively varying air pressure in the barrel chamber when the piston is in its open position.

12. A method as in claim 10 including the step of controlling the flow rate of material through the first channel proportional to movement of the trigger to an operating position from said off position.

13. A method as in claim 10 which includes the step of selectively varying the position of the trigger at which said piston is caused to move to its closed position for closing air flow through the second channel.

* * * * *